US008699744B2

(12) United States Patent
Sakaguchi et al.

(10) Patent No.: US 8,699,744 B2
(45) Date of Patent: Apr. 15, 2014

(54) SPEAKER, HEARING AID, INNER-EAR HEADPHONE, PORTABLE INFORMATION PROCESSING DEVICE, AND AV DEVICE

(75) Inventors: Atsushi Sakaguchi, Osaka (JP); Shuji Saiki, Nara (JP); Toshiyuki Matsumura, Osaka (JP)

(73) Assignee: Panasonic Corporation, Osaka (JP)

( * ) Notice: Subject to any disclaimer, the term of this patent is extended or adjusted under 35 U.S.C. 154(b) by 50 days.

(21) Appl. No.: 13/377,622

(22) PCT Filed: Apr. 13, 2011

(86) PCT No.: PCT/JP2011/002178

§ 371 (c)(1),
(2), (4) Date: Dec. 12, 2011

(87) PCT Pub. No.: WO2011/129108

PCT Pub. Date: Oct. 20, 2011

(65) Prior Publication Data

US 2012/0087525 A1 Apr. 12, 2012

(30) Foreign Application Priority Data

Apr. 14, 2010 (JP) ..... 2010-093590

(51) Int. Cl.
*H04R 25/00* (2006.01)

(52) U.S. Cl.
USPC ..... 381/398; 381/404; 381/392

(58) Field of Classification Search
USPC ..... 381/388, 396, 398, 404, 423, 430, 433, 381/386, 392, 403
See application file for complete search history.

(56) References Cited

U.S. PATENT DOCUMENTS

| | | | | |
|---|---|---|---|---|
| 6,208,743 | B1 | 3/2001 | Marten et al. | |
| 7,236,607 | B2 * | 6/2007 | D'Hoogh | 381/396 |
| 7,877,856 | B2 * | 2/2011 | Fukuyama et al. | 29/594 |

(Continued)

FOREIGN PATENT DOCUMENTS

| | | |
|---|---|---|
| EP | 1 708 542 | 10/2006 |
| JP | 62-241499 | 10/1987 |

(Continued)

OTHER PUBLICATIONS

International Search Report issued May 17, 2011 in corresponding International Application No. PCT/JP2011/002178.
Extended European Search Report issued Nov. 8, 2013 in corresponding European Patent Application No. 11768631.1.

*Primary Examiner* — Davetta W Goins
*Assistant Examiner* — Phylesha Dabney
(74) *Attorney, Agent, or Firm* — Wenderoth, Lind & Ponack, L.L.P.

(57) ABSTRACT

A speaker including: a chassis internally including a magnet; a plate attached to a top face of the magnet; a voice coil disposed in a magnetic air gap formed in an outer perimeter of the plate so as to be vibratable in a vertical direction; a diaphragm having a periphery that is connected to an upper end of the voice coil; and a suspension connecting the diaphragm and the chassis. The suspension includes a first fixing part fixed to the diaphragm and a second fixing part fixed to the chassis. The second fixing part is positioned above the first fixing part, and at least one of the first fixing part and the second fixing part is disposed in an inner region which is a region located inward of the periphery of the diaphragm as seen from above.

13 Claims, 8 Drawing Sheets

(56) References Cited

U.S. PATENT DOCUMENTS

| | | | | |
|---|---|---|---|---|
| 2003/0194106 | A1 | 10/2003 | Tsuda et al. | |
| 2003/0194107 | A1 | 10/2003 | Tsuda et al. | |
| 2004/0076309 | A1 | 4/2004 | Sahyoun | |
| 2004/0223423 | A1 | 11/2004 | Tsuda | |
| 2004/0234096 | A1 | 11/2004 | Tsuda | |
| 2004/0240701 | A1 | 12/2004 | Sahyoun | |
| 2005/0105758 | A1 | 5/2005 | Tsuda | |
| 2005/0117772 | A1* | 6/2005 | Chang | 381/404 |
| 2005/0207612 | A1 | 9/2005 | D'Hoogh | |
| 2006/0177092 | A1* | 8/2006 | Ohta | 381/423 |
| 2008/0205688 | A1 | 8/2008 | Sato | |
| 2009/0003644 | A1 | 1/2009 | Furuya | |
| 2009/0016563 | A1* | 1/2009 | Wei et al. | 381/430 |
| 2011/0044489 | A1* | 2/2011 | Saiki et al. | 381/388 |

FOREIGN PATENT DOCUMENTS

| | | |
|---|---|---|
| JP | 4-111597 | 4/1992 |
| JP | 10-13991 | 1/1998 |
| JP | 2005-522919 | 7/2005 |
| JP | 2005-524309 | 8/2005 |
| JP | 2005-536931 | 12/2005 |
| JP | 2006-191252 | 7/2006 |
| JP | 2009-10806 | 1/2009 |
| JP | 2009-246739 | 10/2009 |
| WO | 03/092324 | 11/2003 |
| WO | 2004/019446 | 3/2004 |
| WO | 2005/117490 | 12/2005 |

* cited by examiner

SPEAKER, HEARING AID, INNER-EAR HEADPHONE, PORTABLE INFORMATION PROCESSING DEVICE, AND AV DEVICE

TECHNICAL FIELD

The present invention relates to reducing diameter of small speakers.

BACKGROUND ART

With the development of digital hearing aids, recent years have seen the realization of a hearing aid that allows hearing with higher sound quality by optimally correcting audibility according to the degree of hearing impairment of a user.

On the other hand, hearing aids are a necessity for carrying out everyday life, and are used by being worn continuously over a long period of time. As such, there is a demand for further miniaturization of hearing aids so that the users do not get tired even during prolonged wearing.

Specifically, there is a demand for further miniaturization of small speakers which are inserted into an ear hole and used as a hearing aid receiver.

In particular, among open fitting hearing aids, the miniaturization of the receiver is important because there is a need to secure an air passage within the outer ear canal.

In an open fitting hearing aid, an air passage is provided between the receiver and the ear hole, and thus the receiver does not completely cover the ear hole when worn. This results in improvements in wearing comfort, such as minimal reverberation of the user's own voice and minimal sensation of ear hole obstruction during use.

Furthermore, in the case of the open fitting type, at or below the fundamental resonance frequency of the speaker, the sound pressure level decreases with the lowering of frequency, and thus reproduction in the low frequencies becomes difficult. Therefore, there is a demand for a speaker which is small and, at the same time, has a low fundamental resonance frequency.

At present, typical hearing aids utilize a balanced armature speaker which is one form of magnetic speaker. The balanced armature type has a structure in which an armature (moving iron), to which a diaphragm is attached, is disposed between two sets of coils and magnets.

In a balanced armature speaker, current is passed through the respective coils to change the magnetic field within the armature. With this, the armature which is held at the center part of a magnetic air gap and is balanced by the magnetic attractive forces of the two magnets vibrates, and sound waves are generated as a result.

Although miniaturization is structurally possible for balanced armature speakers, the magnetic air gap width between the magnets and the armature is narrow, and thus reproduction of low frequencies which requires large amplitude is difficult. In view of this, the electrodynamic system is available as a system for realizing low frequency reproduction.

FIG. 11 is a cross-sectional view of a structure of a conventional electrodynamic small speaker described in Patent Literature (PTL) 1.

The conventional electrodynamic speaker shown in FIG. 11 includes a yoke 1, a magnet 2, a plate 3, a voice coil 4, a diaphragm 5, a magnetic fluid 6, and a suspension 7.

In this structure, stiffness can be reduced by using, for the suspension 7, a material that is softer or a material that is thinner than the diaphragm 5. As a result, the fundamental resonance frequency is lowered, and, with this, reproduction of low frequencies becomes possible.

CITATION LIST

Patent Literature

[PTL 1] Japanese Unexamined Patent Application Publication (Translation of PCT Application) No. 2005-522919

SUMMARY OF INVENTION

Technical Problem

In the conventional configuration, the diaphragm 5 and the suspension 7 are disposed on approximately the same plane. As such, in order to make the outer diameter of the speaker small, it is necessary to reduce the diaphragm area or shorten the length (the length in the horizontal direction in FIG. 11) of the suspension.

However, reducing the diaphragm area leads to sound pressure level deterioration, and shortening the length of the suspension leads to an increase in distortion due to increased bearing capacity nonlinearity, and to a rise of the fundamental resonance frequency caused by increased stiffness. As such, with the conventional small speaker, it is difficult to achieve both further miniaturization and low frequency reproduction.

The present invention is conceived in view of the aforementioned conventional problem and has as an object to provide a speaker that is capable of low frequency reproduction and is smaller than the conventional speaker.

Solution to Problem

In order to achieve the aforementioned object, the speaker according to an aspect of the present invention includes: a chassis internally including a magnet; a plate attached to a top face of the magnet; a voice coil disposed in a magnetic air gap formed in an outer perimeter of the plate so as to be vibratable in a vertical direction; a diaphragm having a periphery that is connected to an upper end of the voice coil; and a suspension connecting the diaphragm and the chassis, wherein the suspension includes a first fixing part fixed to the diaphragm and a second fixing part fixed to the chassis, the second fixing part is positioned above the first fixing part, and at least one of the first fixing part and the second fixing part is disposed in an inner region which is a region located inward of the periphery of the diaphragm as seen from above.

According to this configuration, the first fixing part and the second fixing part are arranged in mutually different positions in the vertical direction (vibration direction of the diaphragm). Furthermore, at least one of the first fixing part and the second fixing part is disposed in the inner region as seen from above.

Specifically, since the diaphragm and the suspension are arranged three-dimensionally, the outer diameter of the speaker can be reduced, for example, without reducing the area of the diaphragm and without reducing the length of the suspension.

In other words, according to the speaker in the present aspect, the outer diameter of the speaker can be reduced while maintaining, for example, a diaphragm area for realizing a desired sound pressure.

Furthermore, according to the speaker in the present aspect, the outer diameter of the speaker can be reduced, for example, without causing the problems such as increased nonlinearity of the bearing capacity of the suspension and increased stiffness of the suspension.

In this manner, the speaker in the present aspect is capable of realizing the suppression of distortion and the lowering of the fundamental resonance frequency, and can be miniaturized further than the conventional speaker.

Furthermore, in the speaker according to an aspect of the present invention, the first fixing part may be disposed in an outer region which is a region surrounding the inner region in the diaphragm, and the second fixing part may be disposed in the inner region in the chassis.

Furthermore, in the speaker according to an aspect of the present invention, the first fixing part may be disposed in the inner region in the diaphragm, and the second fixing part may be disposed in an outer region which is a region surrounding the inner region in the chassis.

Specifically, the positional relationship of the first fixing part and the second fixing part as seen from above is such that either fixing part may be disposed inward, and can be determined flexibly according to, for example, characteristics such as sound quality, ease of speaker assembly, or production efficiency of components such as the suspension.

Furthermore, in the speaker according to an aspect of the present invention, the chassis may include a yoke having a side wall part surrounding the magnet, the plate, and the voice coil, and the second fixing part may be disposed at a position that is in contact with the side wall part.

According to this configuration, the fixing of the chassis-side end of the suspension can be born by the yoke, and thus, for example, the configuration of the speaker is simplified.

Furthermore, since a magnetic air gap is formed in between the plate and the side wall part extending in the vertical direction at the side of the plate, the magnetic distribution becomes nearly vertically asymmetric, with the plate as a center. In other words, the symmetry of the magnetic flux distribution linking the voice coil is improved. As a result, it becomes possible to reduce the nonlinearity caused by magnetic flux density, and, with this, the driving force distortion acting on the voice coil even during vibration with large amplitude is reduced.

Furthermore, in the speaker according to an aspect of the present invention, the chassis may further include a yoke cover covering an opening formed by an upper edge of the side wall part, and the second fixing part may be disposed between the side wall part and the yoke cover.

According to this configuration, since the fixing of the chassis-side end (second fixing part) of the suspension is realized through the attachment of the yoke cover to the yoke, it becomes possible, for example, to simplify the assembly stage of the speaker.

Furthermore, in the speaker according to an aspect of the present invention, the diaphragm may include, in the inner region, a recess having a shape that corresponds to a shape of the first fixing part.

This configuration allows, for example, the attachment of the first fixing part to the diaphragm to be performed precisely and easily.

Furthermore, in the speaker according to an aspect of the present invention, the chassis may include a yoke and a yoke cover, the yoke including a bottom part to which the magnet is connected and a side wall part provided to surround the magnet, and the yoke cover covering an opening formed by an upper edge of the side wall part, and the second fixing part may be disposed at a position which is in contact with an inner surface of the yoke cover.

This configuration allows the second fixing part to be attached to the chassis by using the yoke cover, and thus, for example, the configuration of the speaker is simplified.

Furthermore, in the speaker according to an aspect of the present invention, at least part of the suspension between the first fixing part and the second fixing part may be curved towards the vertical direction.

This configuration, for example, effectively suppresses the distortion caused by the nonlinearity of the bearing capacity of the suspension with respect to the diaphragm.

Furthermore, in the speaker according to an aspect of the present invention, the suspension may be divided into a plurality of parts extending in a radial pattern as seen from above, and (i) each of the parts may include the first fixing part, or (ii) each of the parts may include the second fixing part.

This configuration, for example, reduces the stiffness of the suspension. With this, the fundamental resonance frequency of the speaker can be further lowered, and, as a result, reproduction of sound of lower frequencies becomes possible.

Furthermore, in the speaker according to an aspect of the present invention, the diaphragm may have an elongated shape as seen from above.

According to this configuration, it is possible to realize, for example, a small speaker that is elongated in a direction that is orthogonal to the vibration direction of the diaphragm.

When a small speaker having such a shape is adopted, for example, as a speaker of a hearing aid or inner ear headphone, the hearing aid or the inner ear headphone can be configured such that the diaphragm is inserted inside the ear hole at the time of wearing. As a result, for example, the sound conveyed to the user can be clarified.

Furthermore, in the speaker according to an aspect of the present invention, the diaphragm may have a dome-like three-dimensional shape.

According to this configuration, the rigidity of the entire diaphragm can be improved. Furthermore, an appropriate rigidity can be maintained even when the thickness of the diaphragm is reduced.

Furthermore, the speaker according to an aspect of the present invention may further include a magnetic fluid filling a gap between the voice coil and the plate.

According to this configuration, the magnetic fluid is held between the plate and the voice coil by the magnetic field generated in the magnetic air gap. With this, even when the diaphragm vibrates largely, the diaphragm can vibrate stably without coming into contact with the yoke and the plate, due to the viscosity of the magnetic fluid.

In addition, since the diaphragm support part configured of the magnetic fluid and the support part configured of the second fixing part are separated by a comparatively long distance in the vibration direction of the diaphragm, rolling by the diaphragm can be prevented effectively.

Furthermore, the speaker according to an aspect of the present invention may include two speaker units arranged in series inside the chassis and each including the magnet, the plate, the voice coil, the diaphragm, and the suspension, wherein part of each of adjacent two of the voice coils may be disposed in a shared magnetic air gap which is part of the magnetic air gap and formed between adjacent two of the plates.

According to this configuration, the magnetism of adjacent magnets can be utilized effectively to cause adjacent voice coils to vibrate. Furthermore, since the wall surface of the yoke is not required between two speaker units, the number of diaphragms placed per unit area (that is, the effective vibration area per unit area) can be increased, and thus a high sound pressure level can be obtained as a result.

Furthermore, according to the speaker in the present aspect, a speaker in which the number of speaker units is three or more can be easily realized.

Specifically, in order that the adjacent magnets in the three or more speaker units have mutually inverse polarities, the speaker units are arranged in a grid, a straight line, or a curve. With this, the magnetic flux between these speaker units is effectively utilized, and, as a result, an increase in total diaphragm area attributed to multiple units and miniaturization of the speaker as a whole are both achieved.

Furthermore, the present invention can be realized as a hearing aid, an inner ear headphone, a portable information processing device, and an audio-visual (AV) device, which includes the speaker according to any of the aspects of the present invention.

Advantageous Effects of Invention

The present invention can provide a speaker that is capable of low frequency reproduction and can be further miniaturized than the conventional speaker.

DESCRIPTION OF EMBODIMENTS

Hereinafter, embodiments of the present invention shall be described with reference to the Drawings.

(Embodiment 1)

Figure 1A:
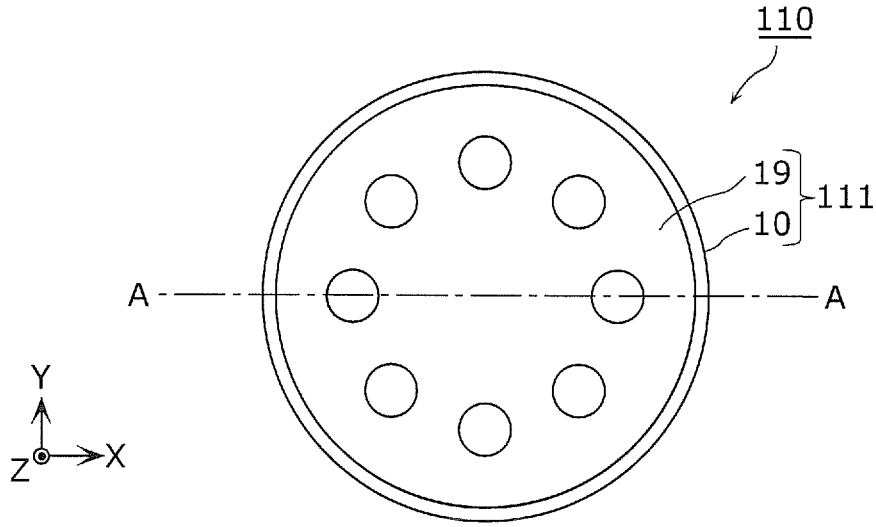
FIG. 1A is a plan view of a speaker in Embodiment 1 of the present invention.
Figure 1B:
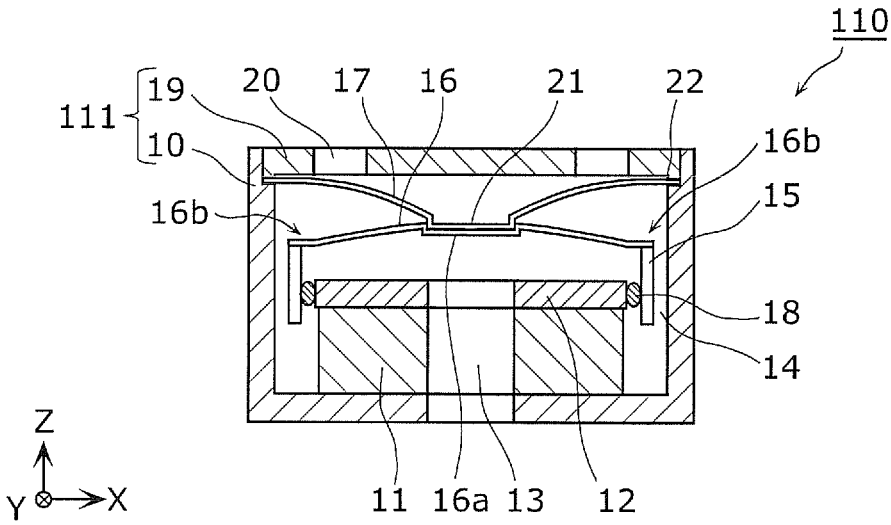
FIG. 1B is a diagram showing the A-A cross-section in FIG. 1A.

A configuration outline of a speaker in Embodiment 1 of the present invention is shown in FIG. 1A and FIG. 1B.

FIG. 1A is a plan view of a speaker 110 in Embodiment 1, and FIG. 1B is a diagram showing the A-A cross-section in FIG. 1A.

The speaker 110 in Embodiment 1 includes a chassis 111, a magnet 11, a plate 12, a voice coil 15, a diaphragm 16, and a suspension 17. It should be noted that the outer diameter of the speaker 110 is, for example, approximately 5 mm to 10 mm.

More specifically, the speaker 110 in Embodiment 1 is configured in the manner described below.

The chassis 111 is configured of the yoke 10 and a yoke cover 19 covering an opening formed by the upper edge of the side wall part of the yoke 10, and a sound hole 20 is provided in the yoke cover 19.

The plate 12 is attached to the top face of the magnet 11. Furthermore, a sound hole 13 is formed by respective holes formed on the yoke 10, the magnet 11, and the plate 12.

The voice coil 15 is disposed in the magnetic air gap 14 formed on the outer perimeter of the plate 12, so as to be vibratable in the vertical direction. Furthermore, in the magnetic air gap 14, a magnetic fluid 18 is filled into a gap between the plate 12 and the voice coil 15.

The diaphragm 16 has a periphery 16*b* connected to the top end of the voice coil 15, and vibrates according to the vibration of the voice coil 15.

The suspension 17 is placed so as to connect the diaphragm 16 and the chassis 111. The suspension 17 includes a first fixing part 21 which is fixed to the diaphragm 16 and a second fixing part 22 which is fixed to the chassis 111. Furthermore, as shown in FIG. 1B, the second fixing part 22 is positioned above the first fixing part 21.

Furthermore, a recess 16*a* having a shape corresponding to the first fixing part 21 is provided in the diaphragm 16, and the first fixing part 21 is fixed to the recess 16*a*. The second fixing part 22 is disposed between the side wall part of the yoke 10 and the yoke cover 19.

At least one of the first fixing part 21 and the second fixing part 22 is disposed in an inner region which is a region that is inward of the periphery 16*b* of the diaphragm 16 as seen from above.

Figure 2:
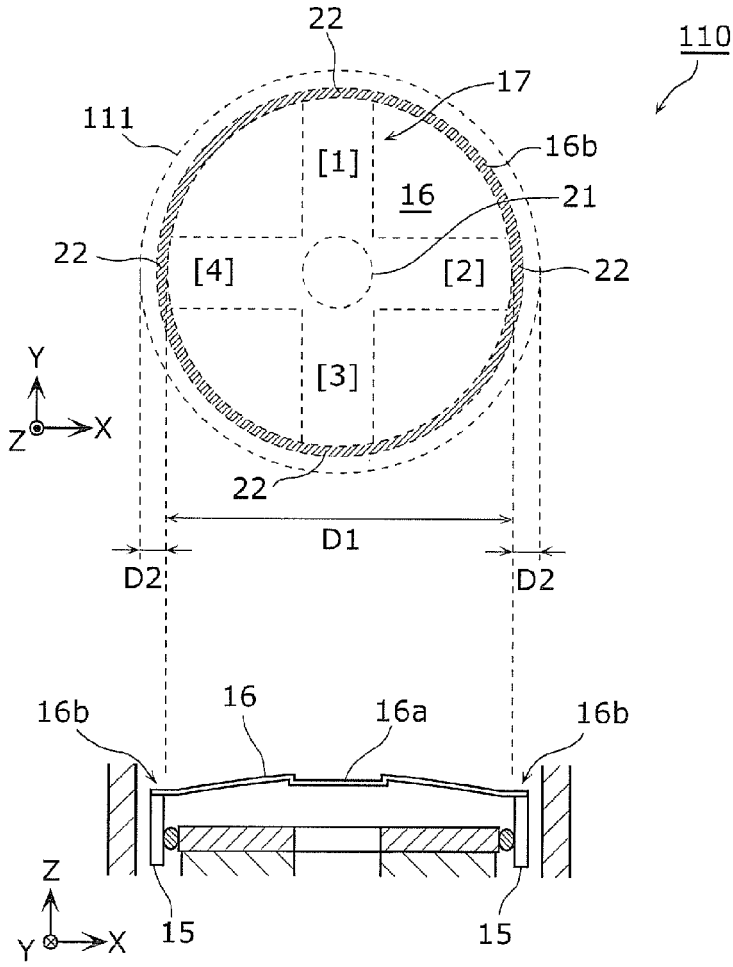
FIG. 2 is a schematic diagram for describing placement positions of a first fixing part and a second fixing part in Embodiment 1 of the present invention.

The placement positions of the first fixing part 21 and the second fixing part 22 in the present embodiment shall be described using FIG. 2.

FIG. 2 is a schematic diagram for describing the placement positions of the first fixing part 21 and the second fixing part 22 in Embodiment 1.

As shown in FIG. 2, the suspension 17 is divided into plural parts extending in a radial pattern as seen from above. In the present embodiment, the suspension 17 is divided into the four parts [1] to [4], and each of the parts includes the second fixing part 22.

Furthermore, the first fixing part 21 is disposed in an inner region D1 which is a region inward of the periphery 16*b*, and the second fixing parts 22 are disposed in an outer region D2 which is a region surrounding the inner region D1.

It should be noted that, for convenience, illustration and description of the speaker 110 in Embodiment 1 is carried out with the side in which the diaphragm 16 is located with respect to the magnet 11 being the "top". In this case, the vibration direction of the diaphragm 16 is the vertical direction. However, there is no substantive difference in the advantageous effect and so on of the speaker 110 regardless of the orientation of the speaker 110. This is the same for all the other embodiments.

The operation of the speaker 110 configured in the above-described manner shall be described. When an electrical signal is inputted to the voice coil 15, the voice coil 15 vibrates according to Fleming's left hand rule. Since the voice coil 15 is connected to the diaphragm 16, sound waves are generated from the diaphragm 16.

According to the speaker 110 in Embodiment 1 of the present invention, the length of the suspension 17 beyond the diaphragm 16, as seen from above, can be made shorter than in the conventional speaker.

With this, the outer diameter of the speaker 110 can be reduced without reducing the area of the diaphragm 16 and without shortening the length of the suspension 17 (the length extending from the first fixing part 21 up to the second fixing part 22; the same is referred to hereafter).

In other words, according to the speaker 110 in the present embodiment, the length of the suspension 17 can be increased compared to that in the structure of the conventional speaker. As a result, a reduction in the stiffness of the suspension 17 lowers the fundamental resonance frequency, thus realizing low frequency reproduction in the speaker 110 which is a small speaker.

Furthermore, the increase in the length of the suspension makes it possible to suppress an increase in distortion caused by nonlinearity of the bearing capacity of the suspension 17 with respect to the diaphragm.

Furthermore, at least part of the suspension 17 located between the first fixing part 21 and the second fixing part 22 is curved towards the vertical direction. This also suppresses increases in distortion caused by nonlinearity of the bearing capacity of the suspension 17 with respect to the diaphragm 16.

Furthermore, the suspension 17 is divided into the four parts extending in a radial pattern as seen from above, and each of these parts includes the second fixing part 22.

This also makes it possible to lower the fundamental resonance frequency of the speaker because the stiffness of the suspension 17 is reduced. As a result, reproduction of low frequencies becomes possible.

Furthermore, the magnetic fluid 18 is held between the plate 12 and the voice coil 15 by the magnetic field generated in the magnetic air gap 14. As such, even when the diaphragm 16 vibrates largely, the diaphragm 16 can vibrate stably without coming into contact with the yoke 10 and the plate 12, due to the viscosity of the magnetic fluid 18.

In addition, the positions for supporting the diaphragm 16 become the two points of a support part of the voice coil 15 configured of the magnetic fluid 18 and a support part configured of the second fixing part 22 of the suspension 17. As such, for example, even when the diaphragm 16 vibrates with large amplitude during bass reproduction, the diaphragm 16 is stably supported, thus making it possible to prevent the diaphragm 16 from vibrating abnormally due to the rolling phenomenon and so on.

Furthermore, the side wall part of the yoke 10 extends in the vertical direction, at the side of the plate 12. As such, the symmetry of the magnetic flux distribution linking the voice coil 15 is improved. As a result, it becomes possible to reduce the generation of distortion in the driving force acting on the voice coil 15 caused by nonlinearity of magnetic flux density distribution.

Furthermore, the sound hole 13 provided at the center of the yoke 10, the magnet 11, and the plate 12 prevents the air chamber in the back surface (bottom surface) of the diaphragm 16 from being sealed by the magnetic fluid 18. In other words, the rising of the fundamental resonance frequency of the speaker due to the air stiffness in such air chamber can be avoided. Furthermore, the sound from the sound hole 13 can be used as a reproduced sound of the speaker.

Furthermore, the second fixing part 22 is disposed between the side wall part of the yoke 10 and the yoke cover 19. Specifically, since the fixing of the chassis 111-side end (second fixing part 22) of the suspension 17 is realized through the attachment of the yoke cover to the yoke, it becomes possible, for example, to simplify the assembly stage of the speaker.

Furthermore, since the three-dimensional form of the diaphragm is a dome shape as shown in FIG. 1B, the rigidity of the diaphragm 16 as a whole, for example, can be improved. Furthermore, an appropriate rigidity can be maintained even when the thickness of the diaphragm 16 is reduced.

Here, the recess 16*a* having a shape corresponding to the first fixed part 21 is provided at the center part of the dome-shaped diaphragm 16. The recess 16*a* allows, for example, the attachment of the first fixing part 21 to the diaphragm 16 to be performed precisely and easily.

It should be noted that the diaphragm 16 need not include the recess 16*a*. In this case, it is preferable that the first fixing part 21 of the suspension 17 be formed in a curved-shape which follows the dome-shape of the diaphragm 16.

Furthermore, in the present embodiment, the cross-section of the suspension 17, as a whole, is shaped like a roll, as shown in FIG. 1B. However, any shape is acceptable as long as it is a shape that provides a margin for expansion and contraction in the vibration direction by making at least a part between the first fixing part 21 and the second fixing part 22 curved. For example, the overall cross-sectional shape of the suspension 17 may be a wave-shape.

It should be noted that although the first fixing part 21 is disposed in the center part of the diaphragm 16 in the present embodiment, it is sufficient that the first fixing part 21 be disposed somewhere in the inner region D1 in the diaphragm 16 (see FIG. 2).

Furthermore, the second fixing part 22 may be disposed in the inner region D1 instead of the outer region D2. For example, the second fixing part 22 may be disposed in the inner surface of the yoke cover 19, at a position approximately directly above the magnetic fluid 18, in FIG. 1B.

In this case, for example, the second fixing part 22 may be fixed to such position on the inner surface of the yoke cover 19 using an adhesive and so on.

Specifically, as long as at least one of the first fixing part 21 and the second fixing part 22 is disposed in the inner region D1 as seen from above, the three-dimensional arrangement of the suspension 17 and the diaphragm 16 such as that shown in FIG. 1B can be realized.

Furthermore, the second fixing part 22 does not need to be in contact with the inner surface of the yoke cover 19, and the second fixing part 22 may be, for example, fixed to the chassis 111 by being embedded in the side wall part of the yoke 10.

(Embodiment 2)

Figure 3A:
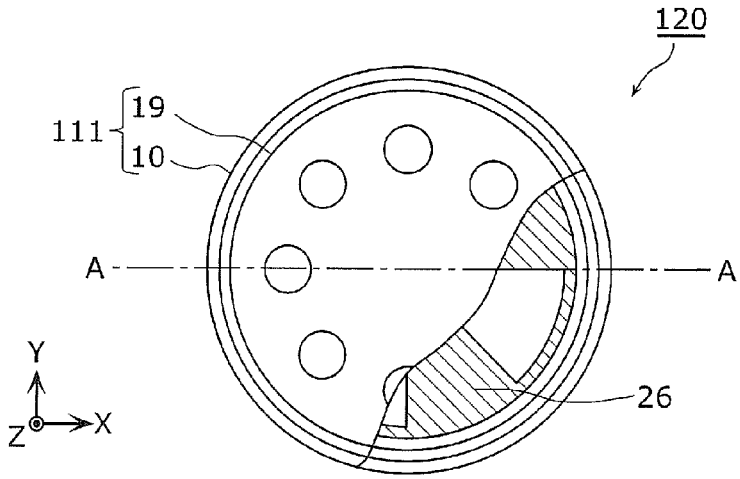
FIG. 3A is a plan view of a speaker in Embodiment 2 of the present invention.
Figure 3B:
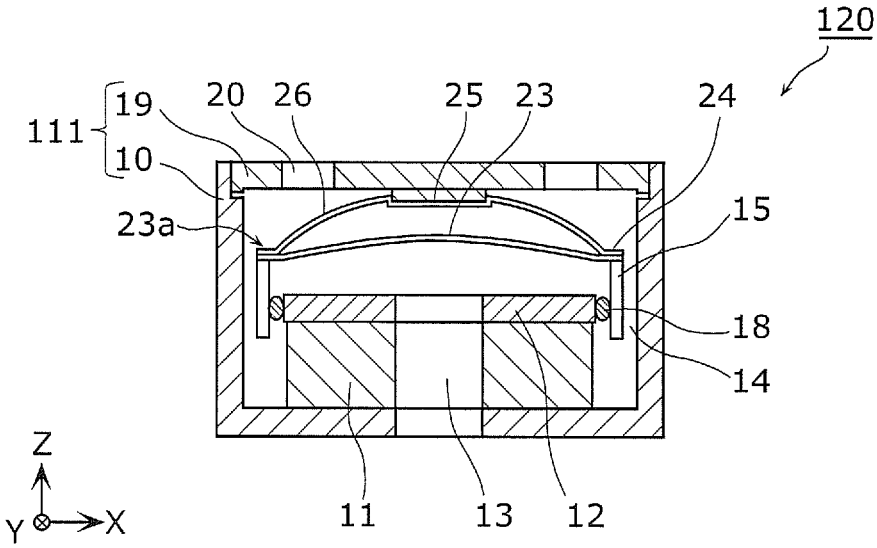
FIG. 3B is a diagram showing the A-A cross section in FIG. 3A.

A configuration outline of a speaker in Embodiment 2 of the present invention is shown in FIG. 3A and FIG. 3B. In FIG. 3A and FIG. 3B, constituent elements which are the same as those in FIG. 1A and FIG. 1B are given the same reference signs and their description shall be omitted.

FIG. 3A is a plan view of a speaker 120 in Embodiment 2, and FIG. 3B is a diagram showing the A-A cross section in FIG. 3A.

It should be noted that in FIG. 3A, illustration of part of the yoke cover 19 has been omitted so that part of a suspension 26 inside the speaker 120 can be shown.

The speaker 120 in Embodiment 2 includes a suspension 26, a first fixing part 24 which is a part of the suspension 26 which is fixed to a diaphragm 23, and a second fixing part 25 which is a part of the suspension 26 which is fixed to the yoke cover 19.

Furthermore, like the suspension 17 in Embodiment 1, the suspension 26 is divided into parts that extend in a radial pattern as seen from above. Furthermore, in Embodiment 2, each of these parts includes the second fixing part 24.

The operation of the speaker 120 configured in the above-described manner shall be described. The mechanism by which sound is generated from the diaphragm 23 when an electrical signal is applied to the voice coil 15 is the same as in Embodiment 1.

The speaker 120 in Embodiment 2 is significantly different from the speaker 110 in Embodiment 1 in the point that the second fixing part 25 is fixed to the yoke cover 19.

Specifically, in the speaker 120, the second fixing part 25 of the suspension 26 is provided further inward than a periphery 23*a* of the diaphragm 23. More specifically, the second fixing part 25 is disposed in an inner region which is a region that is further inward than the periphery 23*a* of the diaphragm 23 as seen from above. Still more specifically, the second fixing part 25 is disposed at a position that is in contact with the center part of the inner surface of the yoke cover 19.

Furthermore, the first fixing part 24 is disposed in an outer region that surrounds the inner region as seen from above.

With this, even when the outer diameter of the speaker 120 is the same as the outer diameter of the speaker 110 in Embodiment 1 for example, the ratio of the diaphragm area with respect to the outer diameter of the speaker 120 can be increased further than the ratio in Embodiment 1.

As such, improvement of sound output efficiency can be achieved even with the relatively small-diameter speaker 120. Alternatively, even with the same diaphragm area as in Embodiment 1, the outer diameter of the speaker 120 can be made smaller than that of the speaker 110, and thus a further miniaturized speaker 120 can be realized.

It should be noted that, in the present embodiment, the first fixing part 24 is disposed in the periphery 23*a* of the diaphragm. However, it is sufficient that the first fixing part 24 be disposed somewhere on the diaphragm. In other words, the first fixing part 24 may be disposed in the inner region in the diaphragm 23.

Furthermore, other advantageous effects such as the advantageous effect resulting from the diaphragm being a dome shape and the advantageous effects attributed to the magnetic fluid 28 are the same as in Embodiment 1, and thus detailed description is omitted.

(Embodiment 3)

Figure 4A:
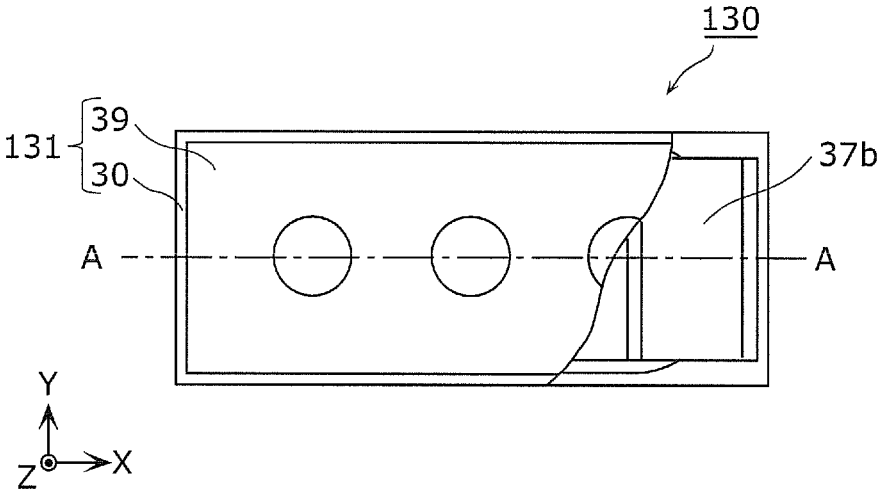
FIG. 4A is a plan view a speaker in Embodiment 3 of the present invention.
Figure 4B:
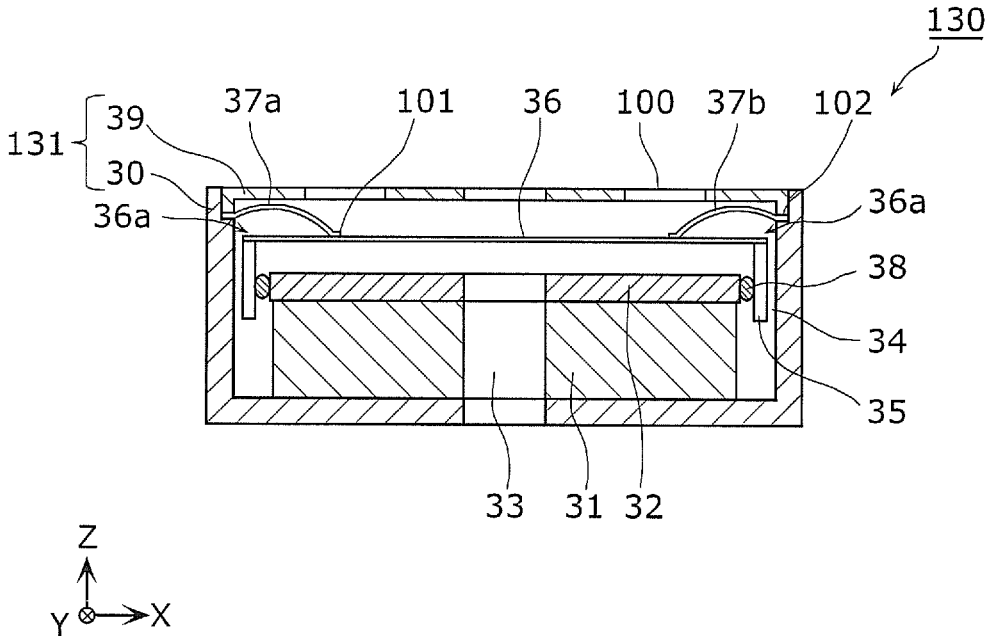
FIG. 4B is a diagram showing the A-A cross-section in FIG. 4A.

A configuration outline of a speaker in Embodiment 3 of the present invention is shown in FIG. 4A and FIG. 4B.

FIG. 4A is a plan view of a speaker 130 in Embodiment 3, and FIG. 4B is a diagram showing the A-A cross-section in FIG. 4A.

It should be noted that in FIG. 4A, illustration of part of a yoke cover 39 has been omitted so that part of a suspension 37 inside the speaker 130 can be shown.

The speaker 130 in Embodiment 3 includes: a chassis 131 configured of a yoke 30 and a yoke cover 39; a magnet 31; a plate 32; a sound hole 33; a magnetic air gap 34 formed in the outer perimeter of the plate 32; a voice coil 35 disposed in the magnetic air gap 34 in a manner which allows vibration in the vertical direction; a rectangular diaphragm 36; suspensions 37*a* and 37*b* each of which has a roll-like cross-sectional shape and is provided on one of the short sides of the rectangular diaphragm 36 opposite the other of the suspensions to form a straight line with the other; and a magnetic fluid 38 which is filled into a gap between the plate 32 and the voice coil 35 inside the magnetic air gap 34. A sound hole 100 is provided in the yoke cover 39.

Furthermore, each of the suspensions 37*a* and 37*b* includes a first fixing part 101 which is fixed to the diaphragm 36 and a second fixing part 102 which is fixed to the chassis 131.

Furthermore, the first fixing part 101 is disposed in an inner region which is a region that is further inward than a periphery 36*a* of the diaphragm 36 as seen from above, and the second fixing part 102 is disposed in an outside region which is a region that is outside the inner region as seen from above.

Specifically, the second fixing part 102 is disposed between the side wall part of the yoke 30 and the yoke cover 39.

The operation of the speaker 130 configured in the above-described manner shall be described. The mechanism by which sound is generated from the diaphragm 36 when an electrical signal is applied to the voice coil 35 is the same as in Embodiment 1.

The speaker 130 in Embodiment 3 is significantly different from the speaker 110 in Embodiment 1 in the point that the shape of the diaphragm 36 as seen from above is elongated.

Specifically, in the present embodiment, the shape of the diaphragm 36 as seen from above is rectangular. In conformity to such shape of the diaphragm 36, the suspension for supporting the diaphragm 36 is provided by being divided into the suspensions 37*a* and 37*b* which are respectively disposed for each of the short ends of the diaphragm 36.

Specifically, the suspensions 37*a* and 37*b* are an example of two members that are obtained by dividing a single suspension into parts that extend in a radial pattern.

Here, the suspensions 37*a* and 37*b* are three-dimensionally arranged on the diaphragm 36. As such, for example, when compared with the conventional speaker which uses a divided suspension disposed along the outer edges of the short sides of the diaphragm 36, the size of the diaphragm 36 in the long-side direction can be reduced.

Furthermore, the length (length in the X-axis direction) of the suspensions 37*a* and 37*b* can be increased compared to the conventional structure. As such, it is possible to suppress increases in the nonlinearity of the bearing capacity of the suspensions 37*a* and 37*b* with respect to the diaphragm 36 and increases in the stiffness of the suspensions 37*a* and 37*b*. As a result, suppression of distortion and reduction of the fundamental resonance frequency can be realized.

It should be noted that although each one of the suspensions 37*a* and 37*b* is disposed on an opposite one of the short sides of the diaphragm as the other suspension, each one may be disposed opposite the other on the long sides of the diaphragm. In this case, although the effective area of the diaphragm 36 is reduced compared to that when the suspensions are arranged on the short sides, the diaphragm can be supported more stably because the length with which the diaphragm 36 is supported by the suspensions 37*a* and 37*b* increases.

Furthermore, each of the suspensions 37*a* and 37*b* may be arranged in the same manner as in Embodiment 2. In other words, the first fixing part 101 may be disposed in the outer region and the second fixing part 102 may be disposed in the inner region as seen from above.

Furthermore, both the first fixing part 101 and the second fixing part 102 may be disposed in the inner region as seen from above.

In any of these cases, the speaker 130 for which both low frequency reproduction and miniaturization are possible can be realized.

Furthermore, as long as the diaphragm 36 is elongated when seen from above, shapes other than a rectangle are acceptable. For example, the diaphragm 36 as seen from above may be of a shape obtained by rounding off the corners of a rectangle, and may also be ellipsoidal.

Furthermore, the three-dimensional shape of the chassis 131 need not be cuboid as shown in FIG. 4A and FIG. 4B, and an elongated overall shape is sufficient.

In this manner, since the diaphragm 36 is elongated, it is possible to realize, for example, the small speaker 130 having a shape that is elongated in a direction orthogonal to the vibration direction of the diaphragm 36.

When the speaker 130 is adopted, for example, as a sound output device of a hearing aid or inner ear headphone, the hearing aid or the inner ear headphone can be configured such that the diaphragm is inserted inside the ear hole at the time of wearing. As a result, for example, the clarity of the sound conveyed to the user can be improved because the effective vibration area inside the ear hole is increased.

Furthermore, other advantageous effects such as the advantageous effect of the curving of at least a part of each of the suspensions 37*a* and 37*b* and the advantageous effect attributed to the magnetic fluid 38 are the same as in Embodiment 1, and thus detailed description is omitted.

(Embodiment 4 Hearing Aid)

Next, an example of a device in which a speaker according to any of the aspects of the present invention is provided shall be described.

First, a hearing aid 150 equipped with the speaker 110 in Embodiment 1 shall be described as Embodiment 4.

Figure 5:
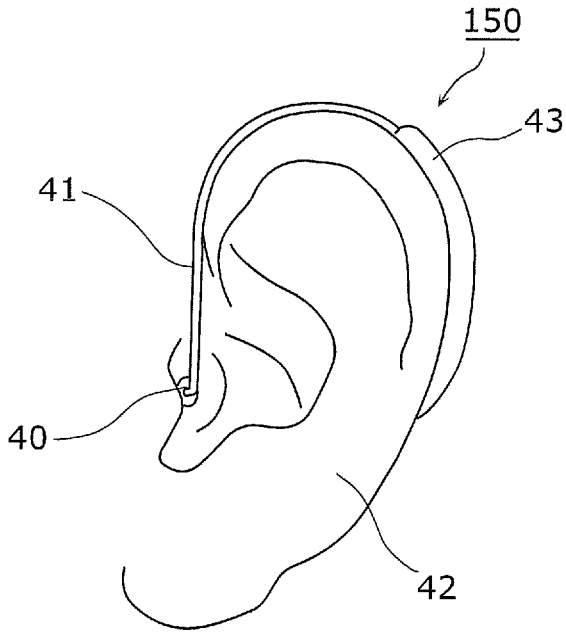
FIG. 5 is a diagram showing an example of an external appearance of a hearing aid in Embodiment 4 of the present invention.

FIG. 5 is a diagram showing an example of the external appearance of the hearing aid 150 in Embodiment 4.

It should be noted that FIG. 5 shows the external appearance of a state in which the hearing aid 150 is worn on an auricle 42 of the user.

The hearing aid 150 shown in FIG. 5 includes a receiver part 40, a lead tube 41, and a hearing aid body 43.

Figure 6:
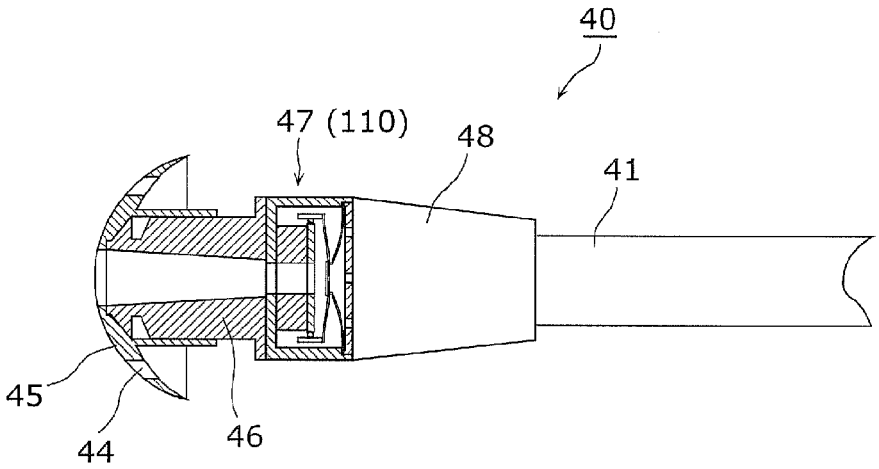
FIG. 6 is a magnified cross-sectional view of a receiver part in the hearing aid shown in FIG. 5.

FIG. 6 is a magnified cross-sectional view of the receiver part 40 in the hearing aid 50 shown in FIG. 5.

The receiver part 40 includes an ear tip 45, an air passage hole 44, an ear tip connection 46, a receiver 47, and a lead tube connection 48.

It should be noted that, in the present embodiment, the speaker 110 in Embodiment 1 is adopted as the receiver 47 and that the details of the speaker 110 are as described in Embodiment 1, and thus description thereof shall not be repeated here.

Furthermore, the cross-section for when the speaker 110 is adopted as a sound output device in an inner ear headphone is also the same as, for example, the cross-sectional structure shown in FIG. 6, and an ear tip, and so on, for wearing by the user is provided in the inner ear headphone.

The constituent elements of the hearing aid 150 which uses the speaker 110 can be broadly divided into two. One is the hearing aid body 43 which is worn on the ear so as to positioned above the auricle 42 and on the back side of the auricle 42, and the other is the receiver part 40 which is positioned in at least one of the inside of the external auditory canal or the opening of the external auditory canal.

The operation of the hearing aid 150 configured in the above-described manner shall be described. A microphone provided in the hearing aid body 43 converts input sound into an input audio signal and transmits the signal to a signal processing unit included in the hearing aid body 43. In the signal processing unit, the input audio signal is processed and an output audio signal is generated.

The generated output audio signal is transmitted to the receiver 47 by passing through the lead tube 41. The receiver 47 converts the output audio signal into an output sound, and reproduces, from the diaphragm 16, the output sound which is outputted to the user via the sound hole 13 and the ear tip 45.

In this manner, the receiver 47 in the present embodiment operates in the hearing aid 150 as a speaker for reproducing an output audio signal.

Here, the reverberation of the user's own voice and the sensation of obstruction during use exist as inherent problems of a typical hearing aid. These are attributable to the external ear canal being sealed off by the hearing aid.

In the present embodiment, the outer diameter of the receiver 47 (speaker 110) is made smaller than that of a conventional receiver by arranging the diaphragm 16 and the suspension 17 three-dimensionally in the receiver 47 (see FIG. 1B for example).

As a result, it is possible to secure an air passage configured of the air passage hole 44, between the wall surface of the external auditory canal and the receiver 47, thereby realizing the hearing aid 150 of the open fitting type which does not seal-off the external auditory canal.

In addition, the length of the suspension 17 can be increased compared with the conventional structure. As such, the stiffness of the suspension 17 can be reduced, and the fundamental resonance frequency becomes lower as a result. In other words, even as an open fitting type, the hearing aid 150 which is capable of sufficient low frequency reproduction and has high sound quality is realized.

It should be noted that, instead of the speaker 110 in Embodiment 1, the hearing aid 150 may include, as the receiver 47, the speaker 120 in Embodiment 2 or the speaker 130 in Embodiment 3.

For example, when the hearing aid 150 includes the speaker 130 in Embodiment 3 as the receiver 47, the hearing aid 150 can be configured such that the diaphragm 36 is inserted inside the ear hole when worn.

This is also the same for the inner ear headphone, and any of the speakers 110, 120, and 130 may be adopted as a sound output device in the inner ear headphone.

(Embodiment 5 Portable Terminal Device)

Next, an example of a portable terminal device in which a speaker according to any of the aspects of the present invention is provided shall be described as Embodiment 5.

Figure 7:
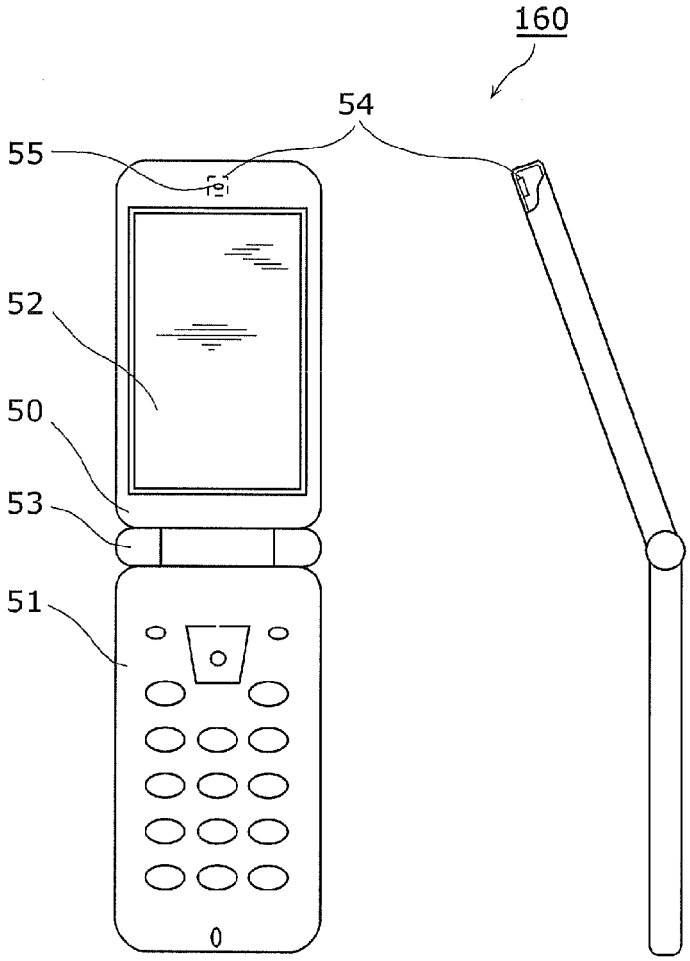
FIG. 7 is a diagram showing an example of an external appearance of a cellular phone in Embodiment 5 of the present invention.

FIG. 7 is a diagram showing an example of an external appearance of a cellular phone 160 in Embodiment 5. It should be noted that the cellular phone 160 shown in FIG. 7 is an example of the portable information processing device in the present invention.

The cellular phone 160 shown in FIG. 7 includes an upper housing 50, a lower housing 51, a liquid crystal screen 52, a hinge 53, a speaker 54, and a sound hole 55.

The cellular phone 160 shown in FIG. 7 is of the folding-type having a main body configured of the upper housing 50 and the lower housing 51. The upper housing 150 and the lower housing 151 are rotatably connected, with the hinge 53 as a center.

The liquid crystal screen 52 is provided at the front face of the upper housing 50. The speaker 54 is disposed inside the upper housing 150, at the top end of the liquid crystal screen 52.

It should be noted that, for example, the speaker 110 in Embodiment 1 described using FIG. 1A and FIG. 1B may be adopted as the speaker 54 although detailed description thereof shall be omitted here as such description would be redundant.

Specifically, the speaker 110 is installed so that the either the sound hole 13 or the sound hole 20 shown in FIG. 1B is connected to the sound hole 55 of the upper housing 50 in FIG. 7.

It should be noted that the speaker 120 in Embodiment 2 or the speaker 130 in Embodiment 3 may be adopted as the speaker 54.

The operation of the cellular phone 160 configured in the above-described manner shall be described. In the cellular phone 160, the signal received by an antenna is processed by the signal processing unit and inputted as a reception signal to the speaker 54, and the sound of the received call is reproduced by the speaker 54.

It should be noted that although not illustrated in FIG. 7, the antenna and the signal processing unit are included in the cellular phone 160 as basic constituent elements.

In this manner, the speaker 54 in the present embodiment is a speaker that reproduces the sound of a received call in the cellular phone 160, and operates as an acoustic transducer called a receiver.

Since liquid crystal screens are becoming bigger in typical cellular phones of late, receivers are being installed at a position in the outer frame at the top part of the housing. As a result, it is becoming difficult to use the cellular phone in a near-sealed state in which the ear is covered in such a way that the sound radiated from the receiver does not leak to the outside.

As such, the sound pressure level deteriorates at or below the fundamental resonance frequency of the receiver, and thus low frequency reproduction becomes difficult.

According to the cellular phone 160 in the present embodiment, it is possible to lower the fundamental resonance frequency of the receiver (speaker 110 for example).

As such, even when a sealed state between the cellular phone 160 and the ear cannot be maintained, there is no deterioration in sound pressure level up to the fundamental resonance frequency, and thus, when the fundamental resonance frequency is set to the neighborhood of 300 Hz for example, sound pressure characteristics that are flat up to such frequency band can be realized.

In this manner, in the cellular phone 160, the quality of the sound of the received call is greatly improved compared to the conventional cellular phone.

In other words, the cellular phone 160 in the present embodiment is highly practical as a late model cellular phone in which the installation position of the receiver is moved aside to the upper part of the housing due to the enlargement of the liquid crystal screen. Furthermore, the cellular phone 160 is highly practical as a fourth-generation cellular phone which is planned to have significantly expanded reproduction bandwidth for low frequency call signals.

(Embodiment 6 Thin-Screen Television)

Next, an example of a thin-screen television in which a speaker according to any of the aspects of the present invention is provided shall be described as Embodiment 6.

Figure 8:
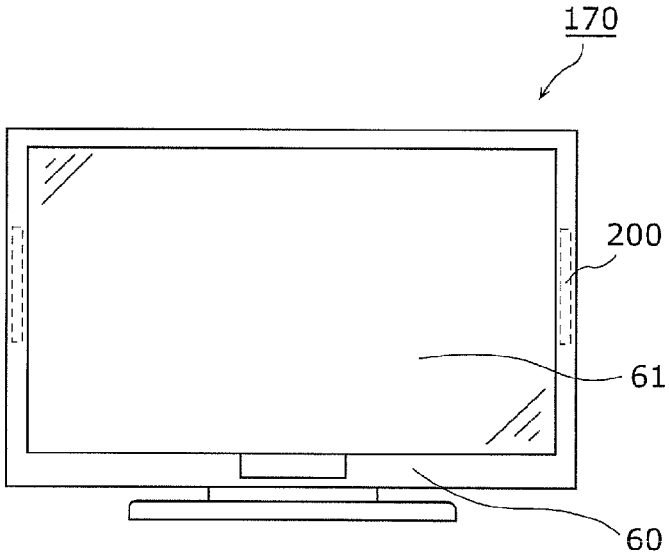
FIG. 8 is a diagram showing an example of an external appearance of a thin-screen television in Embodiment 6 of the present invention.

FIG. 8 is a diagram showing an example of an external appearance of a thin-screen television 170 in Embodiment 6.

The thin-screen television 170 shown in FIG. 8 is an example of the AV device in the present invention, and includes a television housing 60, a display unit 61, and speakers 200 each of which is provided with speaker units arranged in a grid.

The display unit 61 is realized by, for example, a plasma display panel (PDP), a liquid crystal display panel, or an organic EL display panel.

Furthermore, the speakers 200 are provided inside the television housing 60, for example, one on each side of the display unit 61.

Figure 9A:
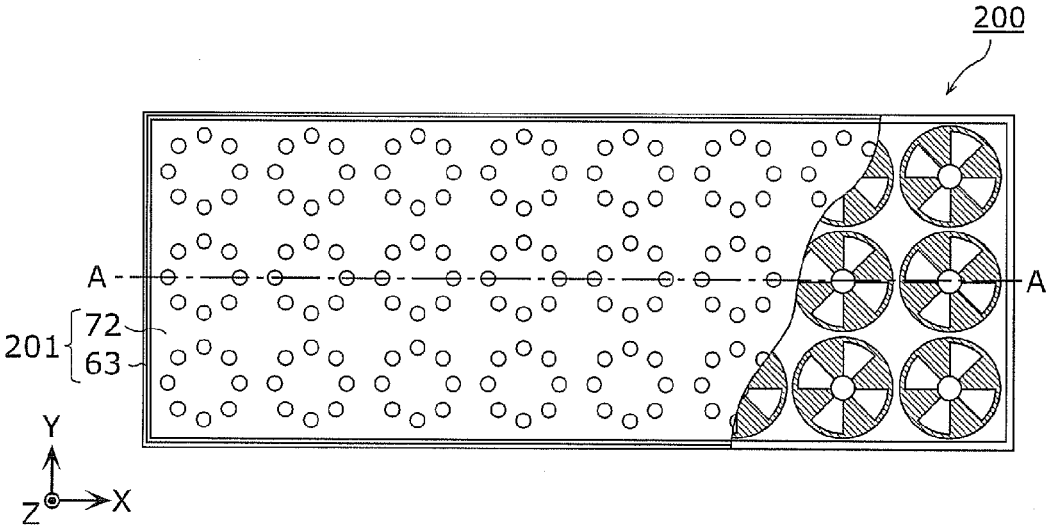
FIG. 9A is a plan view of a speaker in Embodiment 6 of the present invention.
Figure 9B:
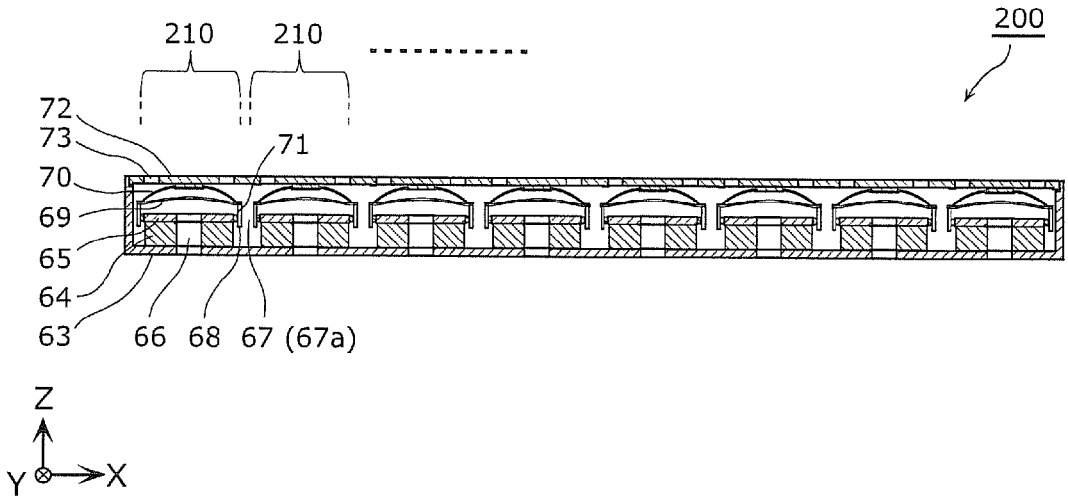
FIG. 9B is a diagram showing the A-A cross section in FIG. 9A.
Figure 10:
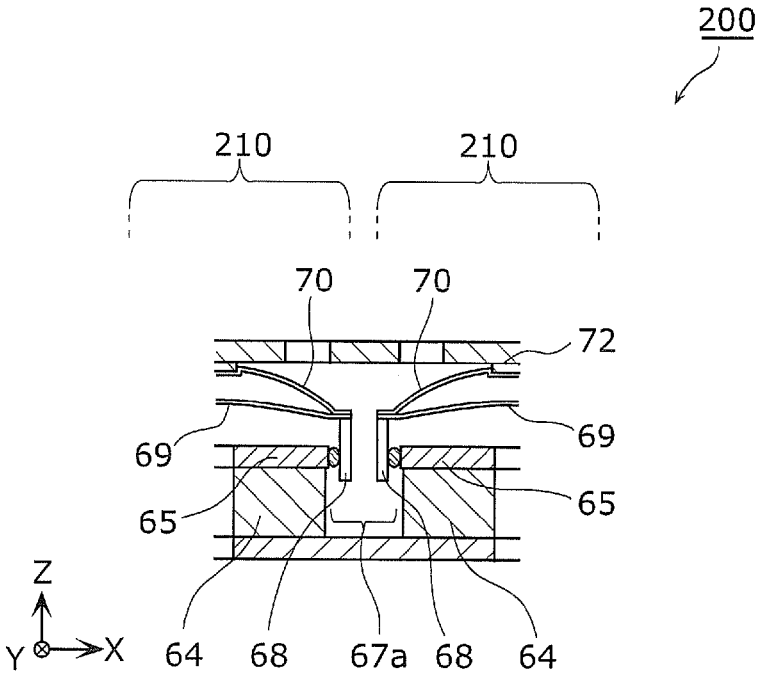
FIG. 10 is a partial magnified view in which part of the cross section shown in FIG. 9B is magnified.
Figure 11:
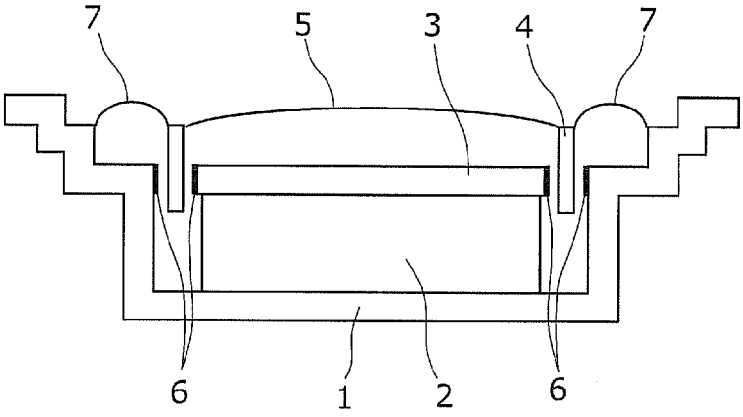
FIG. 11 PRIOR ART
FIG. 11 is a cross-sectional view of a structure of a conventional electrodynamic small speaker.

FIG. 9A is a diagram showing a plan view of the speaker 200 in Embodiment 6, and FIG. 9B is a diagram showing the A-A cross section in FIG. 9A Furthermore, FIG. 10 is a partial magnified view in which part of the cross section shown in FIG. 9B is magnified.

The speaker 200 includes: a chassis 201 configured of a yoke 63, which has an enlarged flat surface part, and a yoke cover 72; and speaker units 210 arranged in series inside the chassis 201. Sound holes 73 are provided in the yoke cover 72.

Each of the speaker units 210 includes a magnet 64, a plate 65, a sound hole 66, a magnetic air gap 67 formed in the outer perimeter of the plate 65, a voice coil 68 held inside the magnetic air gap 67, a diaphragm 69, a suspension 70, and a magnetic fluid 71 filled into a gap between the plate 65 and the voice coil 68.

It should be noted that although the structure of the speaker unit 210 in the present embodiment is the same as the internal structure of the chassis 111 of the speaker 120 in Embodiment 2 (see FIG. 3B), it is acceptable to have the same structure as the internal structure of the chassis 111 of the speaker 110 in Embodiment 1 (see FIG. 1B).

Furthermore, the diaphragm 69 included in the speaker unit 210 may have an elongated shape as seen from above, in the same manner as the diaphragm 36 in Embodiment 3.

In the speaker 200 having the above-described configuration, the plate 65, the magnet 64, and the yoke 63 form a magnetic circuit in a part facing the side wall part of the yoke 63, and, in other parts, two adjacent sets of plates 65 and magnets 64 form a magnetic circuit.

Furthermore, with the speaker units 210 arranged in a grid, adjacent magnets 64 are each polarized so as to have an opposite polarity as the other.

Furthermore, out of the magnetic air gap 67 formed in the outer perimeter of each plate 65, the magnetic air gap 67 that is formed with an adjacent plate 65 is called a shared magnetic air gap 67*a*.

Specifically, in the speaker 200, part of each of two adjacent voice coils 68 is disposed in the shared magnetic air gap 67*a* formed between two adjacent plates 65, as shown in FIG. 10.

By having such a configuration, in the speaker 200, the magnetism of adjacent magnets 64 can be utilized effectively to cause adjacent voice coils 68 to vibrate.

The operation of the thin-screen television 170 configured in the above-described manner shall be described. In the thin-screen television 170, sound is reproduced in each of the speaker units 210 by inputting an audio signal processed by a signal processing unit to the respective speakers 200 located at the left and right.

At such time, each of the diaphragms 69 can be driven in phase, by shifting, to the opposite direction, the orientation of the current flowing to adjacent voice coils 68.

In typical thin-screen televisions of late, there has been continuing progress in thin-framing in which the housing which frames the outer perimeter of the display unit is made narrower to accentuate the size of the screen. As such, the installation space for speakers becomes narrow, and thus there is a demand for increased slimness in speakers.

Furthermore, when a speaker is slimmed-down, it is necessary to reduce the diaphragm area or shorten the length of the suspension.

However, reducing the diaphragm area leads to sound pressure level deterioration, and shortening the length of the suspension leads to an increase in distortion due to increased bearing capacity nonlinearity, and to the rising of the fundamental resonance frequency caused by increased stiffness.

As such, with a speaker included in a conventional thin-screen television, it is difficult to achieve both miniaturization and low frequency reproduction.

In addition, since the sound pressure level deteriorates when the diaphragm area is reduced, it is necessary to apply a large input to the voice coil to cause the diaphragm to vibrate with large amplitude in order to obtain a desired sound pressure level in the low frequencies which require large amplitude.

However, when a large input is applied to the voice coil, there is a possibility of damaging the voice coil due to rising temperature.

Furthermore, when the diaphragm is caused to vibrate with large amplitude using a large input, there are problems such as damage to the suspension, occurrence of distortion due to non-linear vibration, and increase in drive force distortion due to the displacement of the voice coil from the magnetic air gap.

In view of this, an arbitrary slim form can be realized for the speaker 200 by adopting the structure shown in FIG. 9A to FIG. 10 in which the speaker units 210 are arranged in a grid.

Furthermore, in the speaker 200, the yoke 63 does not have to have a wall face between adjacent speaker units 210. As such, the number of diaphragms placed per unit area (that is, the effective vibration area per unit area) can be increased, and thus the sound output efficiency of the speaker 200 can be improved as a result.

In addition, sound pressure level is generally proportional to the effective vibration area, and thus, when obtaining a desired reproduction volume using the speaker 200, the amplitude of the diaphragm 69 can be significantly suppressed compared to when the desired reproduction volume is to be obtained from a conventional speaker.

As a result, the speaker 200 is capable of suppressing problems such as damage to the suspension 70 due to large amplitude and increase in drive force distortion due to the voice coil 68 getting out from the magnetic air gap 67.

Furthermore, since each suspension 70 can be made larger than the suspension in a speaker having the conventional structure, the fundamental resonance frequency of the speaker 200 can be lowered.

Specifically, according to the speaker 200 in the present embodiment, it is possible to combine the above-described the advantageous effect of lowering the fundamental resonance frequency and the holding action on the voice coil 68 of the viscosity of the magnetic fluid 71 that is filled into the magnetic air gap 67, and thereby realize a thin-screen television speaker that excels in low frequency reproduction.

In addition, in the thin-screen television 170, directional control is also possible by controlling each of the speakers 200.

It should be noted that, in the speaker 200, the speaker units need not be arranged in a grid, and may be arranged, for example, in a straight line or a curve.

Furthermore, it is sufficient that the speaker 200 be provided with at least two of the speaker units 210. Specifically, by arranging two speaker units adjacently, the advantageous effects attributed to plural speaker units 210 such as the effective driving of the voice coil 68 in the shared magnetic air gap are also produced in addition to the various advantageous effects attributed to the individual speaker units 210 such as low frequency reproduction, and so on.

The speaker, the hearing aid, the inner ear headphone, the portable information processing device, and the AV device have been described up to this point based on Embodiments 1 to 6.

However, the present invention is not limited to the above-described embodiments. Various modifications to the present embodiments that may be conceived by a person of ordinary skill in the art or those forms obtained by combining the above-described constituent elements, for as long as they do not depart from the essence of the present invention, are intended to be included in the scope of this invention.

For example, in the speaker 200 in Embodiment 6, the speaker units 210 need not have the same configuration. For example, a speaker unit 210 having the same configuration as the speaker 110 in Embodiment 1 and a speaker unit 210 having the same configuration as the speaker 120 in Embodiment 2 may be present together.

Furthermore, for example, any one of the speakers 110, 120, and 130 may be included in the AV device such as the thin-screen television 170 in Embodiment 6.

Furthermore, for example, the speaker 200 may be included in the portable information processing device such as the cellular phone 160 in Embodiment 5.

Furthermore, the speaker 110 need not include the magnetic fluid 18 as long as the voice coil 15 is disposed in the outer perimeter of the plate 12 so as to be vibratable in the vertical direction. The non-necessity of the magnetic fluid is the same for the other speakers (120, 130, and 200).

Furthermore, in Embodiment 5, the cellular phone 160 is given as an example of a mobile information processing device including a speaker according to any of the aspects of the present invention. However, the mobile information processing device in the present invention can be realized as various portable devices other than a cellular phone, such as a portable personal computer, and so on.

Furthermore, the AV device according to the present invention can be realized as various devices other than a television, such as a radio receiver and so on.

[Industrial Applicability]

According to the present invention as described above, arranging the diaphragm and the suspension three-dimensionally makes it possible to reduce the outer diameter of the speaker without reducing the diaphragm area and reducing the length of the suspension.

Furthermore, since the length of the suspension can be increased compared to that in a conventional structure, increase in the stiffness and the nonlinearity of the bearing capacity of the suspension can be suppressed, and, as a result, suppression of distortion and reduction of fundamental resonance frequency can be realized.

Since the speaker according to the present invention is capable of reproducing low frequencies despite being small and slim in shape, the speaker can be implemented as a receiver that is small and capable of reproducing up to low frequencies in an open fitting hearing aid or inner ear headphone and in a portable terminal device such as a cellular phone in which a sealed-state with the call-receiving unit cannot be maintained.

Furthermore, by adopting the speaker according to the present invention as a speaker of an audio-visual device such as a thin-screen television including a liquid crystal display panel, a PDP, or an organic EL display panel for which reduction in thickness is progressing, it is possible to realize an audio-visual device capable of low frequency reproduction of high sound quality.

REFERENCE SIGNS LIST

1, 10, 30, 63 Yoke
2, 11, 31, 64 Magnet
3, 12, 32, 65 Plate
4, 15, 35, 68 Voice coil
5, 16, 23, 36, 69 Diaphragm
6, 18, 38, 71 Magnetic fluid
7, 17, 26, 37*a*, 37*b*, 70 Suspension
13, 20, 33, 55, 66, 73, 100 Sound hole
14, 34, 67 Magnetic air gap
16*a* Recess

16*b*, 23*a*, 36*a* Periphery
19, 39, 72 Yoke cover
21, 24, 101 First fixing part
22, 25, 102 Second fixing part
40 Receiver part
41 Lead tube
43 Hearing aid body
44 Air passage hole
45 Ear tip
46 Ear tip connection
47 Receiver
48 Lead tube connection
50 Upper housing
51 Lower housing
52 Liquid crystal screen
53 Hinge
54, 110, 120, 130, 200 Speaker
60 Television body
61 Display unit
67*a* Shared magnetic air gap
111, 131, 201 Chassis
150 Hearing aid
160 Cellular phone
170 Thin-screen television
210 Speaker unit

The invention claimed is:

1. A speaker comprising:
a chassis internally including a magnet;
a plate attached to a top face of said magnet;
a voice coil disposed in a magnetic air gap formed in an outer perimeter of said plate so as to be vibratable in a vertical direction;
a diaphragm having a periphery that is connected to an upper end of said voice coil; and
a suspension connecting said diaphragm and said chassis,
wherein said suspension includes a first fixing part fixed to said diaphragm and a second fixing part fixed to said chassis,
said second fixing part is positioned above said first fixing part in the vertical direction,
at least one of said first fixing part and said second fixing part is disposed in an inner region which is a region located inward of the periphery of said diaphragm as seen from above,
a portion of said suspension overlaps with said diaphragm as seen from above, and
said first fixing part is disposed in an outer region which is a region surrounding the inner region in the diaphragm, and said second fixing part is disposed in the inner region in said chassis.

2. The speaker according to claim 1,
wherein said chassis includes a yoke and a yoke cover, said yoke including a bottom part to which said magnet is connected and a side wall part provided to surround said magnet, and said yoke cover covering an opening formed by an upper edge of the side wall part, and
said second fixing part is disposed at a position which is in contact with an inner surface of said yoke cover.

3. The speaker according to claim 1,
wherein at least part of said suspension between said first fixing part and said second fixing part is curved towards the vertical direction.

4. The speaker according to claim 1,
wherein said suspension is divided into a plurality of parts extending in a radial pattern as seen from above, and
(i) each of said parts includes said first fixing part, or (ii) each of said parts includes said second fixing part.

5. The speaker according to claim 1,
wherein said diaphragm has an elongated shape as seen from above.

6. The speaker according to claim 1,
wherein said diaphragm has a dome-like three-dimensional shape.

7. The speaker according to claim 1, further comprising
a magnetic fluid filling a gap between said voice coil and said plate.

8. A hearing aid comprising the speaker according to claim 1.

9. An inner ear earphone comprising the speaker according to claim 1.

10. A portable information processing device comprising the speaker according to claim 1.

11. An audio-visual (AV) device comprising the speaker according to claim 1.

12. A speaker comprising:
a chassis internally including a magnet;
a plate attached to a top face of said magnet;
a voice coil disposed in a magnetic air gap formed in an outer perimeter of said plate so as to be vibratable in a vertical direction;
a diaphragm having a periphery that is connected to an upper end of said voice coil; and
a suspension connecting said diaphragm and said chassis,
wherein said suspension includes a first fixing part fixed to said diaphragm and a second fixing part fixed to said chassis,
said second fixing part is positioned above said first fixing part in the vertical direction,
at least one of said first fixing part and said second fixing part is disposed in an inner region which is a region located inward of the periphery of said diaphragm as seen from above,
a portion of said suspension overlaps with said diaphragm as seen from above,
said first fixing part is disposed in the inner region in said diaphragm, and said second fixing part is disposed in an outer region which is a region surrounding the inner region in said chassis,
said chassis includes a yoke having a side wall part surrounding said magnet, said plate, and said voice coil,
said second fixing part is disposed at a position that is in contact with the side wall part,
said chassis further includes a yoke cover covering an opening formed by an upper edge of the side wall part, and
said second fixing part is disposed between the side wall part and said yoke cover.

13. A speaker comprising:
a chassis internally including a magnet;
a plate attached to a top face of said magnet;
a voice coil disposed in a magnetic air gap formed in an outer perimeter of said plate so as to be vibratable in a vertical direction;
a diaphragm having a periphery that is connected to an upper end of said voice coil; and
a suspension connecting said diaphragm and said chassis,
wherein said suspension includes a first fixing part fixed to said diaphragm and a second fixing part fixed to said chassis,
said second fixing part is positioned above said first fixing part in the vertical direction, at least one of said first fixing part and said second fixing part is disposed in an inner region which is a region located inward of the periphery of said diaphragm as seen from above, a portion of said suspension overlaps with said diaphragm as seen from above, two speaker units are arranged in series inside said chassis, each of said two speaker units including said magnet, said plate, said voice coil, said diaphragm, and said suspension, and part of each of adjacent two of said voice coils is disposed in a shared magnetic air gap which is part of the magnetic air gap and formed between adjacent two of said plates.

* * * * *